United States Patent [19]

Briggs

[11] Patent Number: 4,766,914

[45] Date of Patent: Aug. 30, 1988

[54] HAIRDRESSER'S GLOVE

[76] Inventor: Blanca F. Briggs, 1021 E. Las Olas Blvd., Fort Lauderdale, Fla. 33301

[21] Appl. No.: 621,613

[22] Filed: Jun. 18, 1984

[51] Int. Cl.[4] ..... A45D 1/00

[52] U.S. Cl. ..... 132/9; 15/227; 128/62 R; 2/159

[58] Field of Search ..... 132/1, 9, 88.5, 88.7, 132/7, 120, 84 R; 401/8; 15/195, 209 UX, 227, 240; 128/62 R, 157, 67; 2/157, 159

[56] References Cited

U.S. PATENT DOCUMENTS

| | | | |
|---|---|---|---|
| D. 268,967 | 5/1983 | Sami | D2/365 |
| 277,173 | 5/1883 | Thompson | 15/227 |
| 1,200,596 | 10/1916 | Daly | 15/227 |
| 1,528,026 | 3/1925 | Pease | 128/62 R |
| 1,530,327 | 3/1925 | Redlick | 15/227 |
| 1,534,208 | 4/1925 | Gibson | 15/227 UX |
| 2,075,413 | 3/1937 | Welker | 15/227 UX |
| 2,722,706 | 11/1955 | Chopp | 15/227 |
| 3,128,472 | 4/1964 | Raney | 2/159 |
| 3,314,096 | 4/1967 | Berliner | 128/62 R |
| 3,563,250 | 2/1971 | DeFalandre | 132/11 |
| 3,690,331 | 9/1972 | Messer | 132/120 |

*Primary Examiner*—Richard J. Apley
*Assistant Examiner*—Robert Bahr
*Attorney, Agent, or Firm*—Oltman and Flynn

[57] ABSTRACT

A hairdresser's glove having elongated, flexible and resilient, relatively widely spaced comb teeth on the front of the fingers. Each comb tooth has a length of at least one-half the front-to-back dimension of the glove finger or thumb to which it is attached when it is open to receive the respective digit. In addition to the comb teeth, the glove may optionally have provisions for discharging air into the hair at different locations along the fingers and thumb of the glove.

11 Claims, 3 Drawing Sheets

FIG. 1
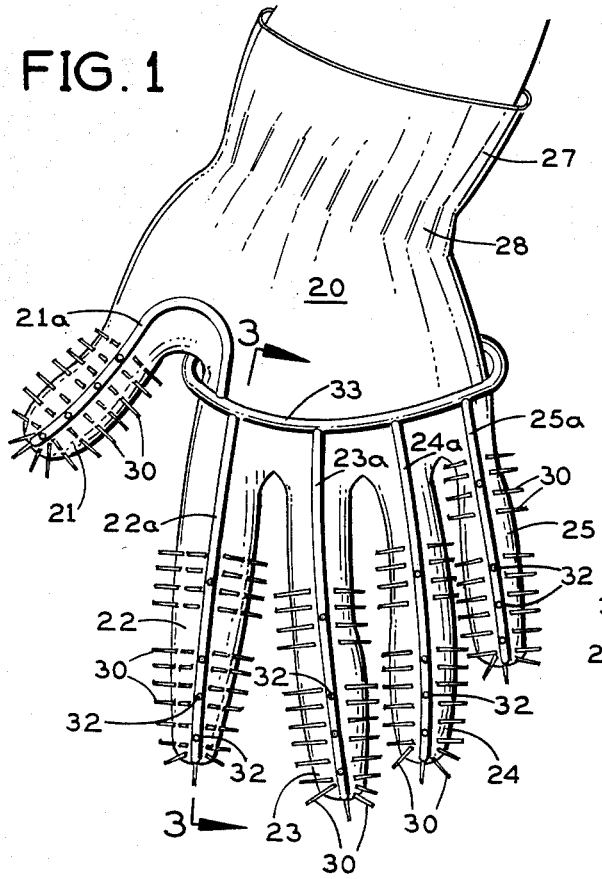
FIG. 2
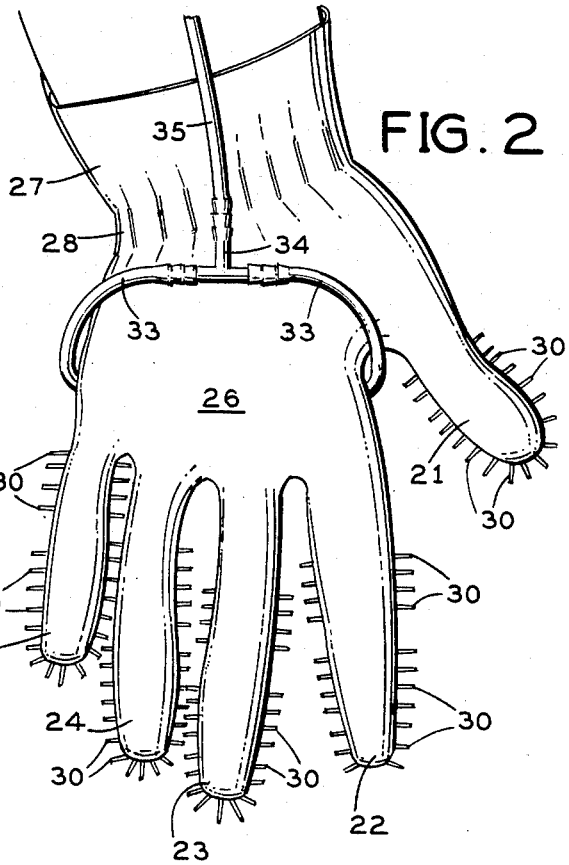
FIG. 3
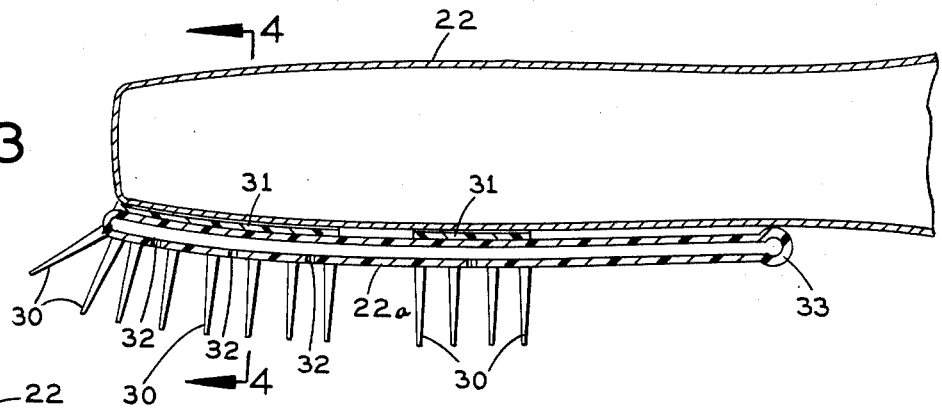
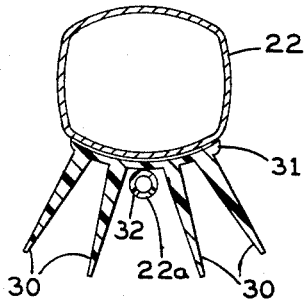
FIG. 4
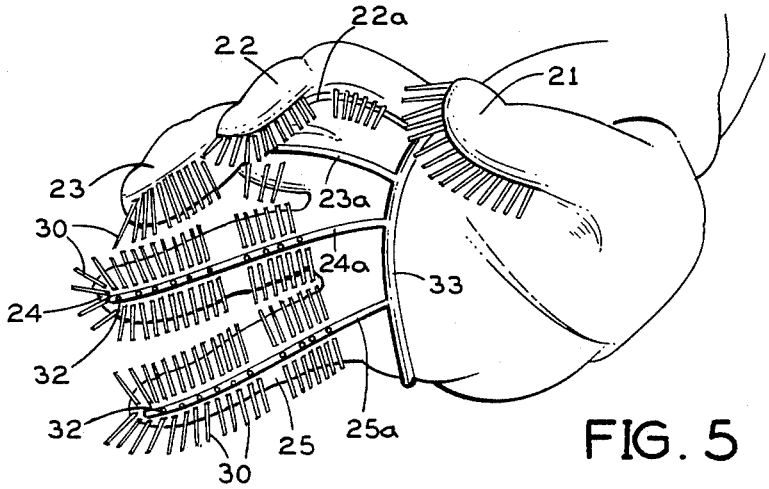
FIG. 5

HAIRDRESSER'S GLOVE

SUMMARY OF THE INVENTION

This invention relates to a hairdresser's glove for use on a person's hair, such as for combing or otherwise fashioning it.

A principal object of this invention is to provide a novel glove for use by a hairdresser which is specially constructed on the front (i.e., the palm side) to fashion a customer's hair.

In certain embodiments of the invention the special construction on the front of the glove comprises relatively widely spaced, long,flexible and resilient comb teeth on the fingers of the glove, and also on the thumb, if desired.

In addition to the comb teeth, the glove may have provision for discharging air into the hair at different locations along the fingers and the thumb of the glove.

Another aspect of the present invention is directed to a frictional pad on the palm of the glove which the hairdresser may use to "scrunch" the customer's hair.

In another embodiment of the invention, substantially the entire palm and the front of the fingers and thumb is covered by a pad of filamentary material, such as nylon or bronze wool.

In yet another embodiment, a cover of spongy material extends over substantially the entire palm and the fingers and thumb of the glove.

DESCRIPTION OF THE DRAWINGS

FIG. 1 is a plan view showing the front of a hairdresser's glove in accordance with a first embodiment of this invention;

FIG. 2 is a similar view of the back of this glove;

FIG. 3 is a section taken along the line 3—3 in FIG. 1 longitudinally of the forefinger of the glove;

FIG. 4 is a cross-section taken along the line 4—4 in FIG. 3;

FIG. 5 is a perspective view of this glove on a hairdresser's hand;

Figure 6:
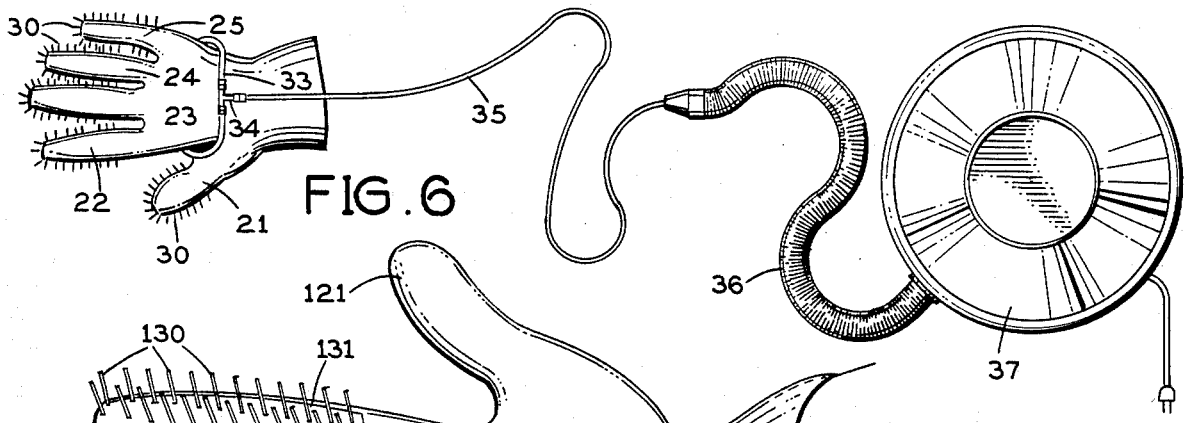
FIG. 6 is a schematic view showing this glove connected to a hair dryer having an air blower.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Referring to FIGS. 1–5, the first embodiment of the present invention is a glove of rubber or other suitable flexible, liquid-impervious material which fits relatively snugly on the hand of a hairdresser or other person using it. The glove has a palm 20 (FIG. 1), a thumb 21, four fingers 22, 23, 24 and 25, a back 26 (FIG. 2), a wrist 27, and a suitable elastic 28 just below the wrist 27 to snugly engage the top of the wearer's hand just below the wearer's wrist. The thumb and all four fingers of the glove flex easily whenever the wearer bends the corresponding digit of his or her hand.

On the front (i.e., the palm side) the thumb 21 and all four fingers 22, 23, 24 and 25 of the glove each support a plurality of forwardly extending, elongated, flexible and resilient comb teeth 30 of suitable rubber-like material. As shown in FIG. 4 for the forefinger 22 of the glove, the comb teeth are arranged in four laterally spaced rows extending lengthwise of the finger. Each comb tooth at its inner end is joined integrally to a base 31 which is adhesively bonded to the front of the glove finger. As shown in FIG. 3, two pads 31 which carry comb teeth 30 are provided on each finger of the glove, one extending between the location of the outer knuckle and the wearer's finger tip and the other extending between this outer knuckle and the middle knuckle of the wearer's finger. The gap between these two pads 31 in FIG. 3 enables the wearer's finger to bend at its outer knuckle without causing interference between comb teeth 30 on the two pads.

Each comb tooth 30 has a length at least one-half the front-to-back dimension of the glove finger or thumb to which it is attached when that glove finger or thumb is open to receive the corresponding digit of the wearer's hand.

Both laterally of the finger, as shown in FIG. 4, and longitudinally of it, as shown in FIG. 3, the comb teeth are spaced from each other throughout the length of each a substantially greater distance than the thickness of each tooth (perpendicular to its length). Also, as shown in these Figures, each comb tooth is slightly tapered, being progressively narrower along its length away from the base 31 which attaches it to the corresponding finger of the glove.

As shown in FIG. 4, the four rows of comb teeth 30 diverge along the length of each away from the glove finger. That is, the lateral separation between the teeth in neighboring rows increases in a direction away from the glove finger. Also, as shown in FIG. 3, at and near the tip of the glove finger the comb teeth 30 in each longitudinal row diverge, so that they are more widely separated at their free ends than at their attached ends. This angular disposition of the comb teeth, both laterally and longitudinally, of the glove finger contributes to the desired combing action.

While the comb teeth are shown in detail in FIGS. 3 and 4 only for the forefinger 22 of the glove, it is to be understood that the comb teeth on the thumb 21 and each of the other fingers 23, 24 and 25 are arranged substantially the same way.

This embodiment of the invention also has provision for discharging air at different points along the front of each finger and the thumb. As shown in FIG. 1, an elongated tube **22*a* of flexible and resilient material extends centrally along the front of the forefinger of the glove. Similar tubes 21*a*, 23*a*, 24*a* and 25*a* extend along the front of the thumb and the remaining fingers of the glove, with at least one row of comb teeth 30 on each side of the tube. Each tube has a plurality of small openings 32 on the front at intervals along its length. An unperforated flexible header tube 33 encircles the glove at its palm 20 and is connected to the adjacent end of each of the thumb and finger tubes 21***a*, 22*a*, 23*a*, 24*a* and 25*a*. On the back side of the glove (FIG. 2) the opposite ends of header tube 33 are connected through a T-fitting 34 to a supply tube 35. As shown in FIG. 6, the supply tube 35 extends from the glove to the outlet hose 36 of an electrically energized air blower in a hair dryer 37 of known design. With this arrangement pressurized air from this blower is discharged through the openings 32 in the tubes on the front of the thumb and fingers of the present glove into the hair of the person on which the glove is being used.

Alternatively, the supply tube 35 may be connected to the air inlet side of a vacuum cleaner to draw air through the person's hair and into the openings 32 on the front of the thumb and fingers of the present glove.

Figure 7:
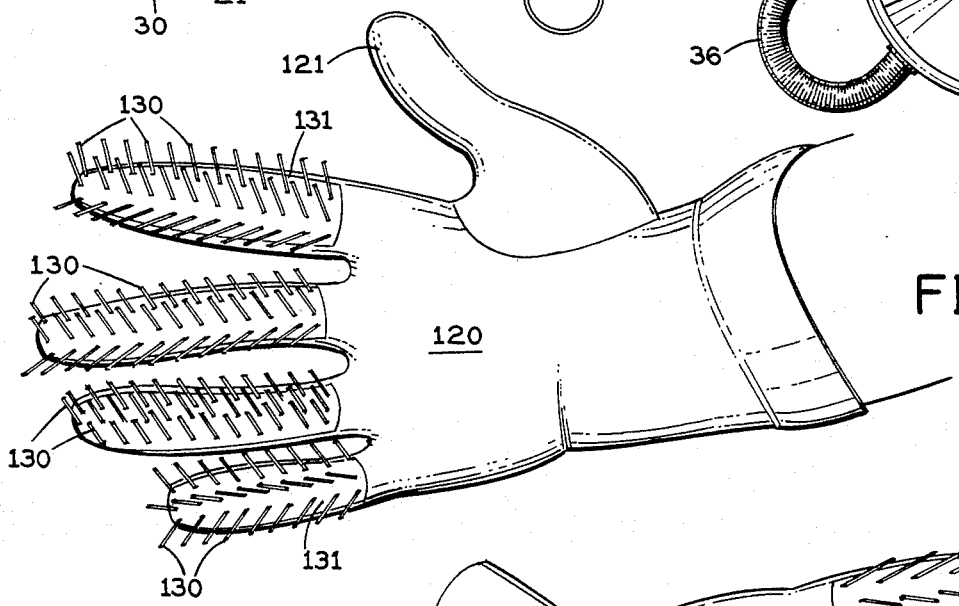
FIG. 7 is a plan view showing the front of a second embodiment of the present glove.

FIG. 7 shows a second embodiment of the invention, corresponding elements of which are given the same reference numerals plus 100 as those in FIGS. 1–6, so that a detailed description of all these elements need not be repeated. In FIG. 7, the comb teeth 130 are on the four fingers of the glove but not on the thumb 121. On each finger the comb teeth are arranged in three rows running longitudinally of the finger. One each finger of the glove a single base pad 131 supports all of the teeth 130 for that finger. The air supply tubing arrangement is omitted from this embodiment of the invention.

Figure 8:
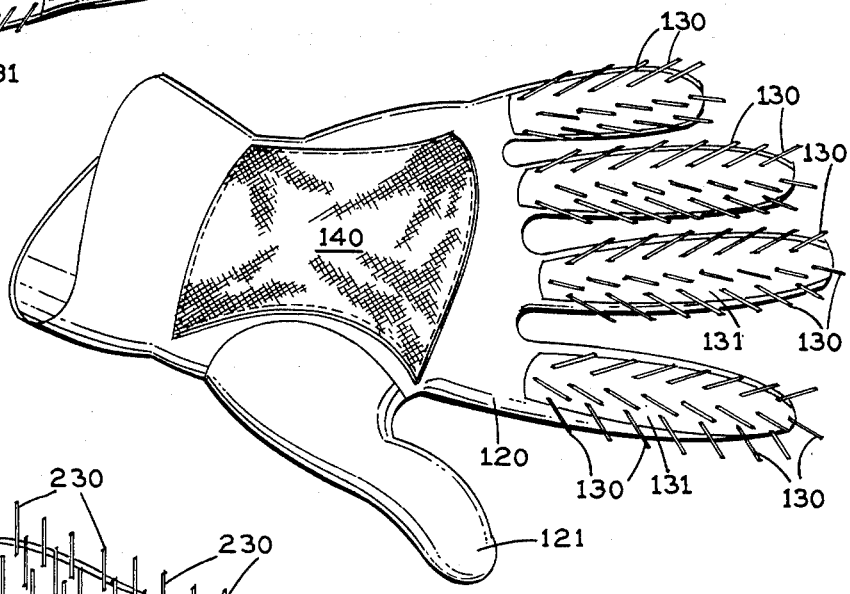
FIG. 8 is a plan view showing the front of a third embodiment of the present glove.

FIG. 8 shows a third embodiment of the present glove which is identical to the embodiment of FIG. 7 except for the addition of a frictional pad 140 covering most of the palm 120 on the front of the glove. This pad may be of any flexible material presenting a roughened or irregular filamentary surface which tends to hold the strands of a person's hair instead of sliding freely through the hair. The purpose of this palm pad 140 on the glove is to grip the hair when the hairdresser is "scrunching" the hair. The comb teeth on the front of the fingers in the FIG. 8 glove are the same as those on the glove of FIG. 7 and are given the same reference numeral 130.

Figure 9:
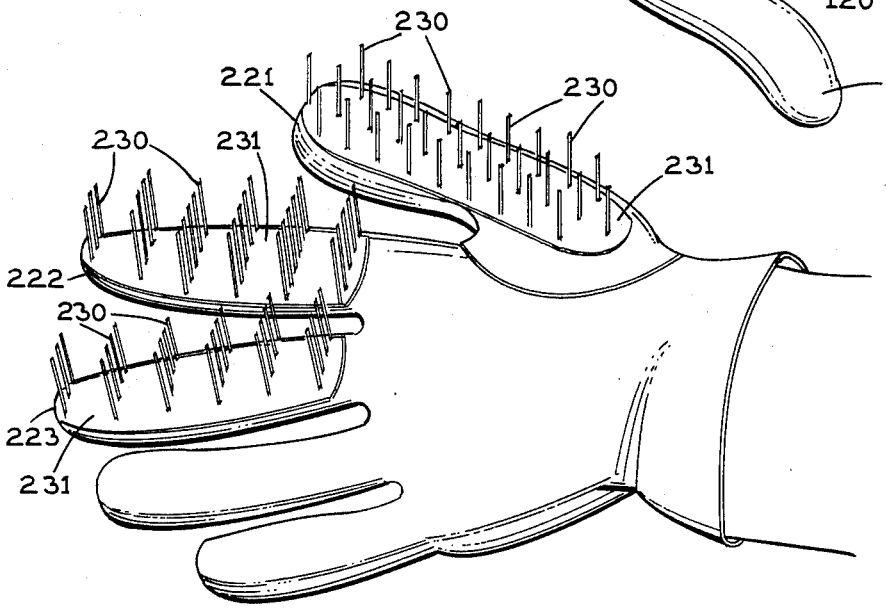
FIG. 9 is a plan view showing the front of a fourth embodiment.

FIG. 9 shows a fourth embodiment in which the comb teeth 230 are provided only on the thumb 221, forefinger 222 and longest finger 223 of the glove. On each the teeth 230 extend substantially parallel to each other. As shown in FIG. 9 these teeth are arranged in laterally extending, straight rows which are spaced apart in succession along the length of the corresponding finger or the thumb of the glove.

Figure 10:
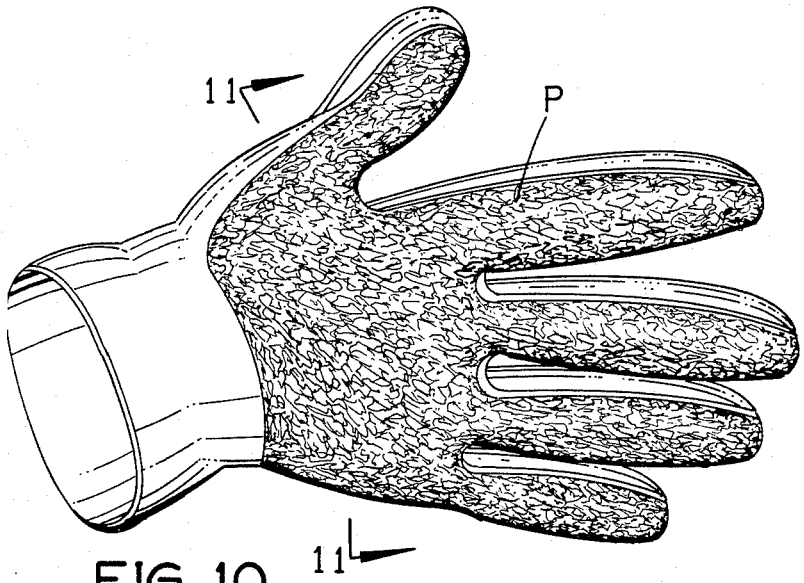
FIG. 10 is a similar view of a fifth embodiment.
Figure 11:
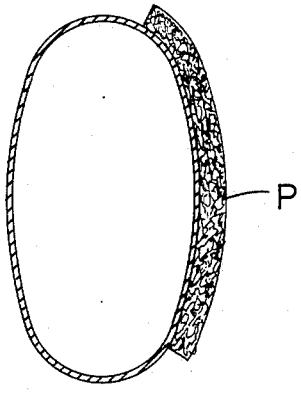
FIG. 11 is a cross-section taken along the line 11—11 in FIG. 10.

FIGS. 10 and 11 show a fifth embodiment of the present glove which has a filamentary pad P of nylon, bronze wool, or other suitable material, having a labyrinthine maze of crossing strands throughout its thickness. As shown in FIG. 10, this pad covers substantially the entire palm and the front of each finger and the thumb of the glove, so that whenever the front of the glove engages a person's hair the pad P will tend to securely grip the hair, making it easier for the hairdresser to perform various actions on the hair to shape it.

Figure 13:
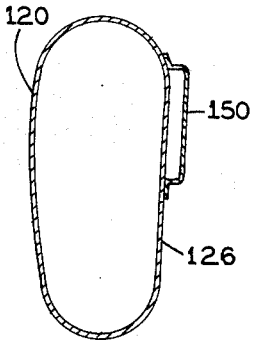
FIG. 13 is a cross-section taken along the line 13—13 in FIG. 12.
Figure 12:
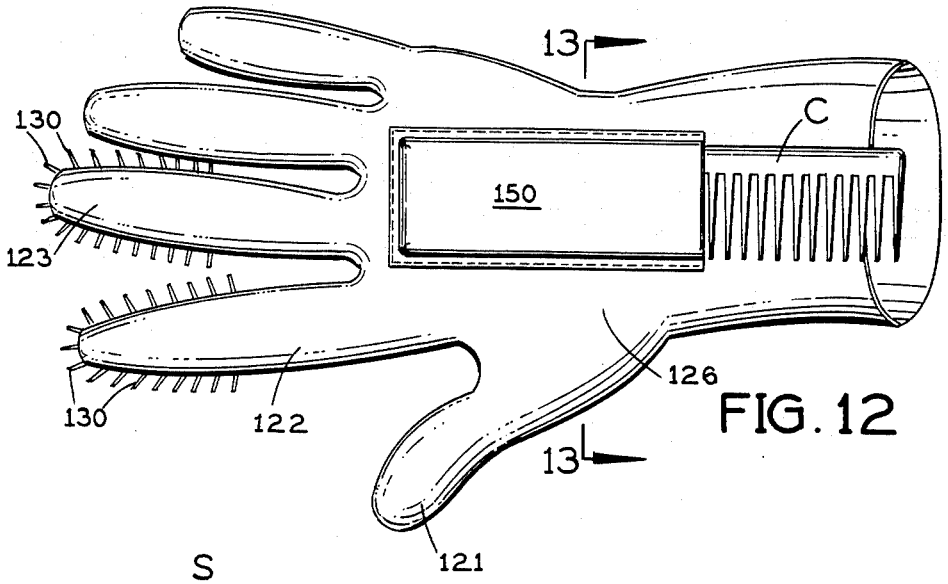
FIG. 12 is a plan view showing the back of a sixth embodiment.

FIGS. 12 and 13 show a sixth embodiment of the invention which is the same as that of FIG. 7 except that it has comb teeth 130 only in the front (palm) side of the forefinger 122 and the big finger 123, and not on the other two fingers, and it has a comb pocket 150 on the back 126 of the glove. This pocket is stitched to the back of the glove at its end toward the fingers and along its opposite sides. The opposite end of the glove (toward the wrist) is open for the slidable insertion and removal of a conventional comb C (FIG. 12).

Figure 14:
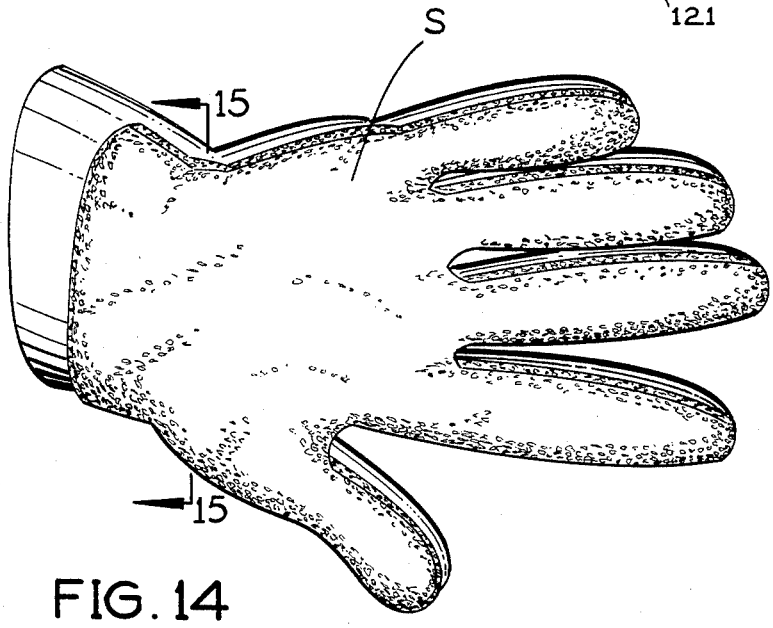
FIG. 14 is a plan view showing the front of a seventh embodiment.
Figure 15:
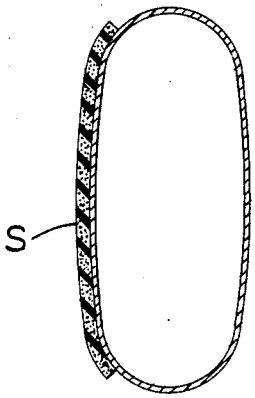
FIG. 15 is a cross-section taken along the line 15—15 in FIG. 14.

FIGS. 14 and 15 show a seventh embodiment of the invention having a pad S of spongy material, which may be synthetic or natural sponge covering the entire palm and the front of each finger and the thumb of the glove. This sponge pad S may be used to hold a liquid solution, such as shampoo, which can be squeezed out into the hair whenever the hairdresser chooses to do so. This sponge pad also preferably has a sufficiently high coefficient of friction that it will facilitate the hairdresser's handling of the hair.

I claim:

1. A hairdresser's glove formed with flexible fingers and having elongated flexible and resilient comb teeth projecting forwardly from at least certain of said fingers and spaced laterally from each other substantially more than the thickness of each comb tooth; said comb teeth having a length in front of said glove fingers at least one-half the front-to-back dimension of the corresponding glove finger when it is open to receive a corresponding finger of the hairdresser's hand.

2. A hairdresser's glove according to claim 1, wherein said teeth are on all of the fingers of the glove.

3. A hairdresser's glove according to claim 2, and having a thumb with teeth thereon as recited in claim 1.

4. A hairdresser's glove according to claim 1, wherein said glove has a thumb;

and said teeth are on the thumb, forefinger and big finger of the glove.

5. A hairdresser's glove according to claim 2 and further comprising:

a plurality of elongated flexible tubes respectively extending along the front of said fingers and each having a plurality of openings on the front at intervals along its length;

and means for passing air to said tubes to be discharged at said openings.

6. A hairdresser's glove according to claim 5 wherein:

each of said tubes extends substantially centrally along the corresponding finger between comb teeth on opposite sides of it.

7. A hairdresser's glove according to claim 5, wherein said means for passing air to said tubes comprises:

a flexible header tube encircling the palm of the glove and communicating with each of said tubes on the fingers of the glove;

and a flexible air supply tube operatively connected to said header tube at the back side of the glove.

8. A hairdresser's glove according to claim 3 and further comprising:

a plurality of elongated flexible tubes respectively extending along the front of said fingers and said thumb and each having a plurality of air discharge openings on the front at intervals along its length, each of said tubes extending substantially centrally along the corresponding finger or thumb between comb teeth on opposite sides of it;

a flexible header tube encircling the palm of the glove and connected thereat to said tubes on the fingers and thumb of the glove;

and a flexible air supply tube connected to said header tube at the back side of the glove.

9. A hairdresser's glove according to claim 1 and further comprising:

means on the palm of the glove presenting an exposed area with a high coefficient of friction.

10. A hairdresser's glove according to claim 1 and further comprising:

means on the back of the glove providing a pocket for holding a comb.

11. A hairdresser's glove formed with flexible fingers and having elongated flexible and resilient comb teeth projecting forwardly from at least certain of said fingers on the front of the glove and spaced laterally from each other substantially more than the thickness of each comb tooth; and means for discharging air at a plurality of locations on the front of the glove.

* * * * *